US006765343B2

(12) United States Patent
Kim

(10) Patent No.: US 6,765,343 B2
(45) Date of Patent: Jul. 20, 2004

(54) FUNNEL IN CATHODE RAY TUBE

(75) Inventor: Byoung Chul Kim, Kyongsangbuk-do (KR)

(73) Assignee: LG. Philips Displays Korea Co., Ltd., Kyongsangbuk-do (KR)

( * ) Notice: Subject to any disclaimer, the term of this patent is extended or adjusted under 35 U.S.C. 154(b) by 19 days.

(21) Appl. No.: 10/163,297

(22) Filed: Jun. 7, 2002

(65) Prior Publication Data

US 2003/0057822 A1 Mar. 27, 2003

(30) Foreign Application Priority Data

Sep. 21, 2001 (KR) ..... 2001-58646
Jan. 15, 2002 (KR) ..... 2002-2283

(51) Int. Cl.[7] ..... H01J 29/00
(52) U.S. Cl. ..... 313/477 R; 313/364
(58) Field of Search ..... 313/477 R, 364

(56) References Cited

U.S. PATENT DOCUMENTS 5,962,964 A 10/1999 Sano et al.
6,396,204 B1 * 5/2002 Park et al. ..... 313/440

* cited by examiner

*Primary Examiner*—Sandra O'Shea
*Assistant Examiner*—Sumati Krishnan
(74) *Attorney, Agent, or Firm*—Birch, Stewart, Kolasch & Birch, LLP

(57) ABSTRACT

A funnel in a CRT includes a body part welded to a panel, a cone part connected to the body part having a deflection yoke fitted thereto, and a neck part connected to the cone part having an electron gun sealed therein. The cone part is formed such that $\Delta Y/\Delta X=\{YD-(DD*\sin\theta 2)\}/\{XD-(DD*\cos\theta 2)\}$ is greater than 4, where DD denotes a diagonal length, XD denotes a long axis length, YD denotes a short axis length, and θ2 denotes a diagonal angle between the long axis and the short axis.

10 Claims, 8 Drawing Sheets

FUNNEL IN CATHODE RAY TUBE

This application claims the benefit of the Korean Application Nos. P2001-58646 filed on Nov. 21, 2001, and P2002-2283 filed on Jan. 15, 2002, which are hereby incorporated by reference.

BACKGROUND OF THE INVENTION

1. Field of the Invention

The present invention relates to a cathode ray tube (CRT), and more particularly, to a funnel in a CRT, which can secure an adequate vacuum strength, and improve a deflection sensitivity, one of deflection yoke efficiencies, and a wedge insert ability.

2. Background of the Related Art

A related art CRT will be explained, with reference to FIGS. 1 and 2.

The related art CRT is provided with a panel 10 and a funnel 20 welded to rear of the panel 10 with frit glass. The panel 10 has flat or curved outside surface and inside surface, and the funnel 20 is a cone formed.

In the meantime, there is an electron gun 19 sealed in a rear part of the funnel 20 for emitting an electron beam, and there is a shadow mask 12 fitted with a gap to the inside surface of the panel 10 having a radius of curvature similar to the radius of curvature of the inside of the panel.

The shadow mask 12 is welded to the frame 14, and the frame 14 is fixed to stud pins 16 fixed to the panel 10 through springs 15. There is an inner shield 17 fixed to the frame 14 by fixing springs 13 for shielding an external magnetic field.

The funnel will be explained with reference to FIGS. 1–3.

The funnel 20 is welded to the panel 10, to form a seal line 31, and a height from the seal line 31 to an outside surface of the panel 10 is a height (OAH) of the panel 10.

The funnel 20 is provided with a body part 21, a cone part 22, and a neck part 23. A connection part of the body part to the cone part 22 is called a TOR (Top Of Round) 33, and a connection part of the cone part 22 to the neck part 23 is called a neck seal 37. There is a RL (Reference Line) 35, a center of the electron beam deflection in the cone part 22, and there is a deflection yoke 18 fitted to the cone part 22 for deflection of the electron beam.

Since the cone part 22 in the funnel 20 is relatively thin compared to other parts, it is required that the cone part 22 is made to reinforce a vacuum strength. Therefore, as shown in FIG. 3, the cone part 22 has a circular section for uniform distribution of stress.

In the meantime, the electron beam from the electron gun 19 is made to make a curvilinear motion in a screen direction by the deflection yoke 18 in the cone part 22. Of a long side direction, a short side direction, and a diagonal direction of a rectangular screen, the diagonal direction is the farthest from a center of the screen. Accordingly, the electron beam deflected to the diagonal direction is required to make a curvilinear motion that is curved the most. Since the long side direction and the short side direction have shorter distances to the screen, the electron beams in the long side direction or the short side direction makes a curvilinear motion that is curved less than the electron beam in the diagonal direction.

When the electron beam hits the cone part 22, a shadow phenomenon occurs in which the electron beam is shaded by an inside surface of cone part 22, so as not to be shown on the screen. Therefore, the cone part 22 has an outside form designed to have a curvature similar to an electron beam path in the diagonal direction.

In the meantime, in order to form a rectangular screen, it is required that the path 22*b* of the electron beam passing through the cone part 22 also has a form close to rectangle, resulting to occur invalid spaces 22*a* in the long side direction and the short side direction through which no electron beam passes.

Disadvantages of the related art CRT, a CRT having a circular cone part 22 section, will be explained.

First, the circular cone part 22 also requires a circular deflection yoke 18. This causes far distances from the deflection yoke 18 to the electron beam both in the long side direction and the short side direction, leading to weaken the force of a magnetic field of the deflection yoke 18 to the electron beam week. Therefore, it is necessary to apply a strong current to the deflection yoke 18 for forming a strong magnetic field, and this requires much power consumption.

Second, in the invalid spaces 22*a* in the long side direction and the short side direction, degrees of close contact of the deflection yoke 18 with the electron beam are poor, to drop deflection sensitivity of the electron beam even if the identical current is applied to the deflection yoke 18.

In the meantime, as environmentally friendly and low powered electric appliances are currently required, improvement of the deflection yoke, that has much power consumption, is essential even in the CRT. However, for fabrication of a low powered deflection yoke, improvement of the form of the cone part in the funnel is required beforehand. Eventually, a CRT having a section similar to the deflection path of the electron beam is suggested. However, the non-circular cone part requires making the vacuum strength thereof weaker than the circular cone part. Besides, the non-circular cone part requires taking the deflection sensitivity, and the wedge insert ability into account. That is, the CRT, particularly, the cone part of the funnel, requires a proper balance of the vacuum strength, the deflection sensitivity, and the wedge insert ability.

SUMMARY OF THE INVENTION

Accordingly, the invention is directed to a funnel in a CRT that substantially obviates one or more of the problems due to limitations and disadvantages of the related art.

An object of the invention is to provide a tunnel in a CRT which permits securing an adequate vacuum strength.

Another object of the invention is to provide a funnel CRT which has an excellent deflection sensitivity and a wedge insert ability.

To achieve these and other advantages and in accordance with the purpose of the invention, as embodied and broadly described, the funnel in a CRT includes a body part welded to a panel, a cone part connected to the body part having a deflection yoke fitted thereto, and a neck part connected to the cone part having an electron gun sealed therein, wherein the cone part is formed such that $\Delta Y/\Delta X=\{YD-(DD*\sin\theta 2)\}/\{XD-(DD*\cos\theta 2)\}$ is greater than 4, where DD denotes a diagonal length, XD denotes a long axis length, YD denotes a short axis length, and $\theta 2$ denotes a diagonal angle between the long axis and the short axis.

Preferably, the $\Delta Y/\Delta X=4.0$–$5.5$, and more preferably, the $\Delta Y/\Delta X=4.0$–$5.0$.

Preferably, a part starting from a part the body part and the cone part are connected to a distance toward the cone part is formed to satisfy the range of the $\Delta Y/\Delta X$. Preferably, the distance is approx. 20 mm.

The diagonal angle is the same with an angle the long axis and the short axis of the screen of the CRT form.

Centers of radiuses of curvatures of a corner of the cone part are on the same line.

In another aspect of the invention, there is provided a funnel in a CRT including a body part welded to a panel, a cone part connected to the body part having a deflection yoke fitted thereto, and a neck part connected to the cone part having an electron gun sealed therein, wherein the funnel is formed such that c/(a+d) is in a range of 0.26–0.37, where 'c' denotes a length of the cone part, 'd' denotes a length of the body part, 'a' denotes a length from a deflection center line of an electron beam to a front end of the cone part in the cone part, and 'b' denotes a length from a deflection center line of an electron beam to a rear end of the cone part in the cone part. Preferably, the c/(a+d) is in a range of 0.30–0.35. Preferably, the funnel is formed such that a/b is in a range of 1.00–1.20.

Thus, the CRT with a non-circular cone part of the invention can provide good vacuum strength, deflection sensitivity, and wedge insert ability.

Thus, the CRT with a non-circular cone part of the present invention can provide good vacuum strength, deflection sensitivity, and wedge insert ability.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

Figure 4:
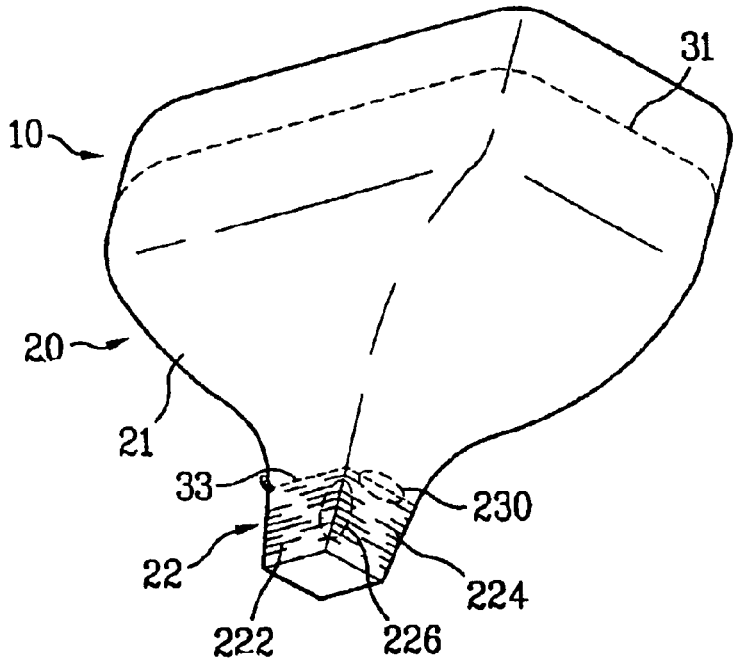
FIG. 4 illustrates a perspective view of a CRT with a non-circular cone part.
Figure 5:
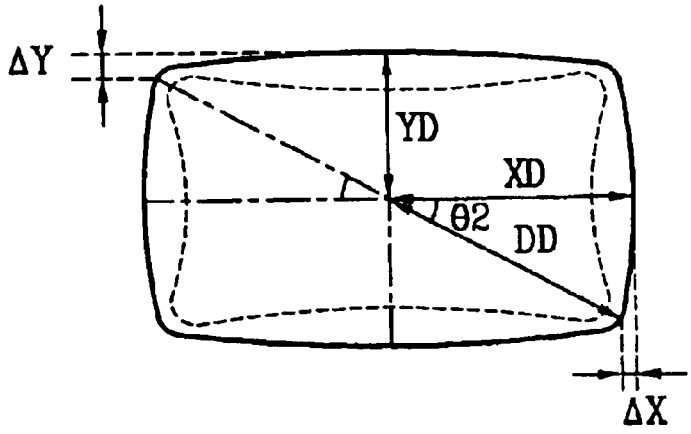
FIG. 5 illustrates a section showing a non-circular cone part in a funnel of a CRT.

Reference will now be made in detail to the preferred embodiments of the invention, examples of which are illustrated in the accompanying drawings FIGS. 4–6.

Similar to the related art, a funnel in a CRT in accordance with a preferred embodiment of the invention also includes a body part 21, a cone part 22, and a neck part. The body part 21 and the neck part may have the same forms as the related art, except the cone part 22 that is non-circular. That is, the cone part 22 is non-circular with different long sides and short sides similar to a deflection path of the electron beam.

In the meantime, in comparison to the funnel with the circular cone part, the funnel with the non-circular cone part is required that the non-circular cone part in the funnel 20 is optimized, because the non-circular cone part 22 has a vacuum strength weaker than the circular cone part, and the shade phenomenon is prevented, in which a shade is occurred on the screen as the electron beam hits an inside surface of the cone part 22. Moreover, it is required that a form of the cone part 22 is determined in view of a wedge insert ability, and a deflection sensitivity. That is, it is required that the cone part 22 of the funnel 20 is determined in view of securing an adequate vacuum strength, prevention of the shade phenomenon, a good wedge insert ability, and a good deflection sensitivity.

In the meantime, the form of the cone part 22 of the funnel 20 is fixed by a length of the cone part 22 and a sectional form of the cone part 22. As shown in FIG. 5, the form of the non-circular cone part 22 is fixed by a length from a center to a long side, (hereafter called as a "long axis length") XD, a length from a center to a short side, (hereafter called as a "short axis length") YD, a length from a center to a corner, (hereafter called as a "diagonal length") DD, and an angle between a "diagonal angle") θ2, and the like.

The form of the cone part of the present invention will be explained in detail.

Once a deflection angle θ1, formed by a line connecting a reference line 35 of the funnel 20 and a diagonal edge of an effective surface of the panel and a CRT axis, is fixed, a length of the CRT is fixed.

The fixed CRT length is allocated into a length of the panel 10 and a length of the funnel 20 appropriately, and the funnel 20 length is allocated into a body part 21 length, a cone part 22 length, and a neck part length appropriately.

In the division of the length, it is required that the followings are taken into account. At first, it is very important that effective distribution and reduction of the vacuum stresses on the seal line 31 and the TOR 33 are very important. Particularly, in the case of the non-circular cone part 22, the distribution and reduction of the vacuum stresses on the TOR 33 are more important, because the TOR 33, a part the radius of curvature is the smallest, is weak to stress, more particularly, to the non-circular cone part 22.

Figure 6:
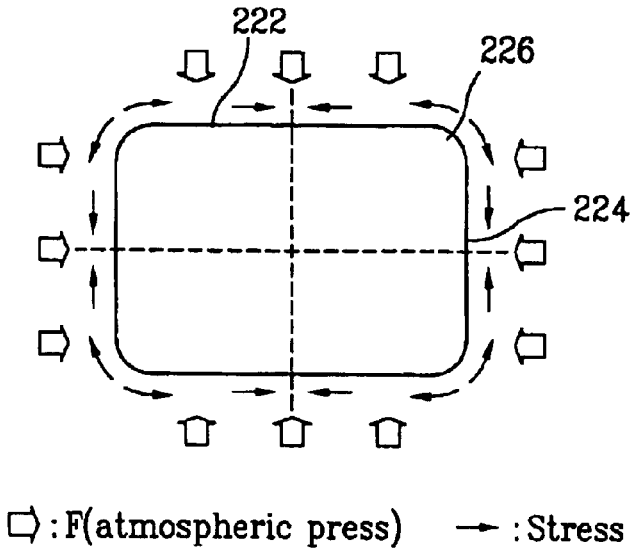
FIG. 6 illustrates stresses occurred in a non-circular cone part in a funnel of a CRT, schematically.

Referring to FIG. 6, a corner 226 of the non-circular cone part 22 has a tension, and the long side part 222 and the short side part 224 have compressive stress. Moreover, it can be known from a vacuum strength analysis that there is a tensile stress at a part (a fore end of the short side) 230 the short side 224 of the neck part 23 and the body part 21 are in contact. Therefore, it is preferable that dimensions of various parts are fixed such that the stresses occurred at the corner 226 of the cone part 22 and the fore end of the short side 230 are reduced.

Figure 3:
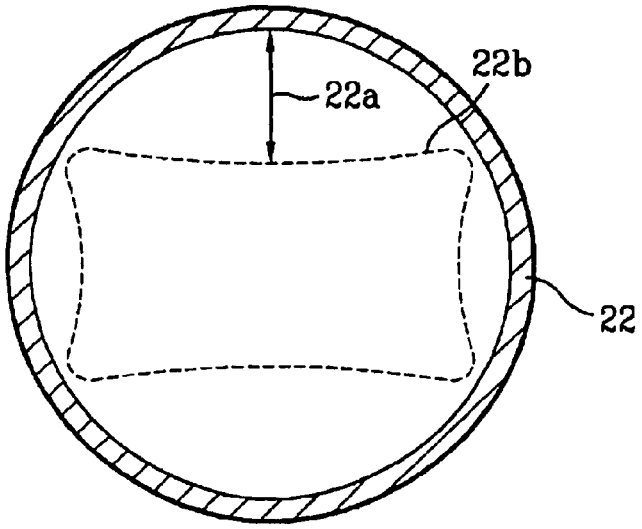
FIG. 3 Related Art
FIG. 3 illustrates a section showing a circular cone part in a funnel of a CRT.

The inventor found that, though forms of the electron beam passing the long side part and the short side part of the cone part 22 are concave (see FIG. 3), concave shapes for the long side part and the short side part of the cone part 22 are not favorable for the vacuum strength.

Because, too short a long axis length XD and too short a short axis length YD in comparison to the diagonal length DD increase a tensile stress at the corner 226 sharply, such that the vacuum strength of the CRT is not adequate, or susceptible to breakage from an external impact.

The inventor found that relations of the diagonal length DD, the long axis length XD, and the short axis length YD appropriate in view of the vacuum strength are obtainable by the following equation.

$$\Delta Y/\Delta X=\{YD-(DD^{*}\sin\theta 2)\}/\{XD-(DD^{*}\cos\theta 2)\}$$

Figure 7:
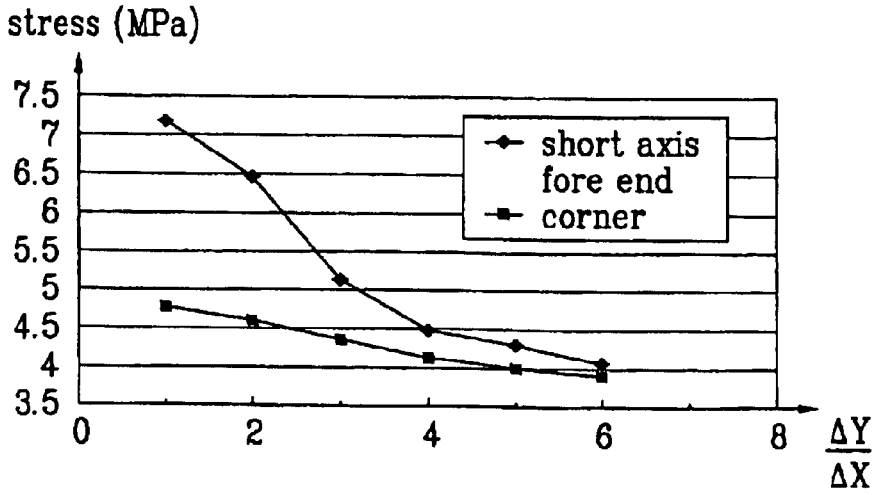
FIG. 7 illustrates a graph showing vacuum strengths varied with forms of a cone part in a CRT with a non-circular cone part.

FIG. 7 illustrates a graph showing vacuum strengths varied with ΔY/ΔX in a CRT with a non-circular cone part. When ΔY/ΔX is 1, 2, 3, 4, 5, or 6, the stress at the short axis fore end 230 is 7.2, 6.5, 5.2, 4.5, 4.4, or 4.2 MPa, and the stress at the corner 226 is 4.8, 4.6, 4.4, 4.2, 4.1, or 4.0 MPa.

As can be noted in FIG. 7, since the short axis length YD increases when the ΔY/ΔX increases, the tensile strength at the short axis fore end 230 and the corner 226 is reduced. Particularly, when the ΔY/ΔX is greater than 4, the tensile stress at the short axis fore end 230 and the corner 226 is below a certain value. Therefore, it is preferable that the ΔY/ΔX is greater than 4 in view of the vacuum strength.

In the meantime, when the ΔY/ΔX is greater than 4, the reduction of the tensile stress at the short axis fore end 230 is slow. When the ΔY/ΔX is great, the short axis length YD is also great, to drop a horizontal direction deflection sensitivity. Therefore, it is preferable that a range of the ΔY/ΔX is limited in view of the horizontal direction defection sensitivity.

Figure 8:
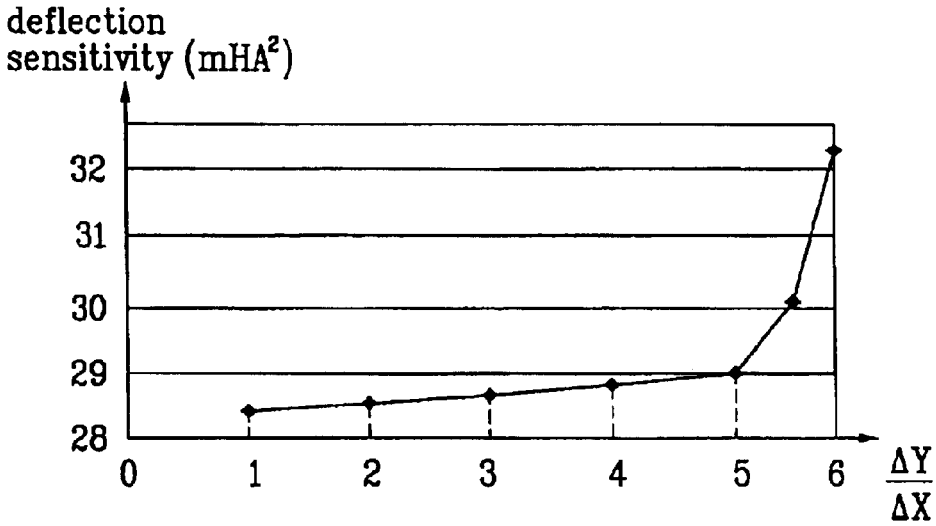
FIG. 8 illustrates a graph showing deflection sensitivities varied with forms of a cone part in a CRT with a non-circular cone part.

FIG. 8 illustrates a graph showing deflection sensitivities varied with the ΔY/ΔX in a CRT with a non-circular cone part. When the ΔY/ΔX is 1, 2, 3, 4, 5, or 6, the deflection sensitivity is 28.5, 28.7, 28.9, 29.1, 29.5, 32.2, $mHA^2$, considering current situation in which power consumption of a large sized appliance is regulated, it is preferable that the horizontal deflection sensitivity is below 30. According to this, it is preferable that the ΔY/ΔX is below 5.5.

It is more preferable that the ΔY/ΔX is below 5 because the horizontal deflection sensitivity increases sharply if the ΔY/ΔX is greater than 5. According to this, it is preferable that the ΔY/ΔX is 4–5.5, and more preferably 4–5.0.

Figure 9:
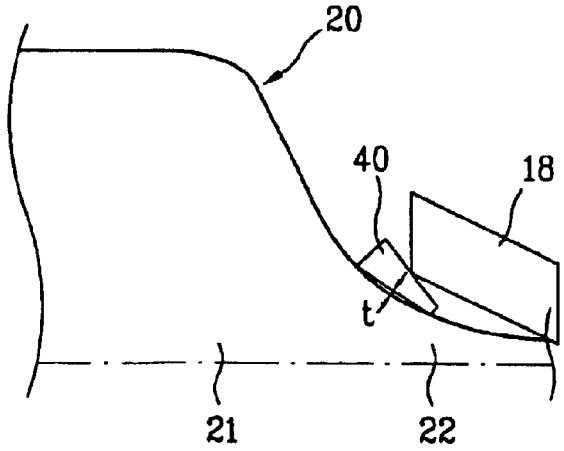
FIG. 9 explains a state a deflection yoke is fixed to a funnel by a wedge, schematically.

In the meantime, referring to FIG. 9, there is a wedge 40 inserted between the short side of the cone part 22 and the deflection yoke 18 for fitting the deflection yoke 18. However, because the non-circular cone part 22 has a sharp change of a curvature at the body part 21 and the cone part 22 in comparison to the circular cone part 22, insertion of the wedge 40 may be difficult, or contact of the wedge 40 may be poor. Therefore, it is preferable that a range of the ΔY/ΔX is fixed taking insertion of the wedge into account. It is preferable that the short axis length YD is made long, to reduce a sharp slope in a part connecting the cone part 22 and the body part 21 to the maximum, for easy insertion of the wedge.

Figure 10:
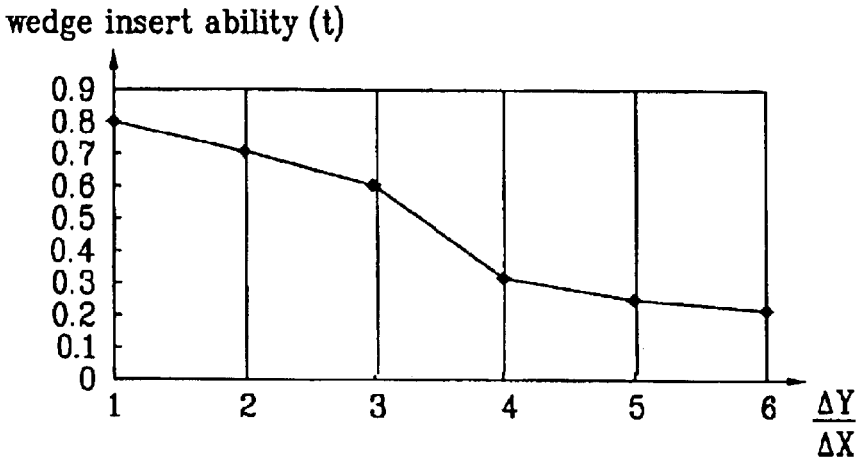
FIG. 10 illustrates a graph showing an insert ability of a wedge varied with forms of a cone part in a CRT with a non-circular cone part.

FIG. 10 illustrates a graph showing an insert ability of a wedge with reference to a short side at which the body part 21 and the cone part 22 are met. When the ΔY/ΔX is 1, 2, 3, 4, 5, or 6, a gap between the wedge and the funnel is 0.8, 0.7, 0.6, 0.3, 0.23, or 0.2 mm.

As noted in FIG. 10, a degree 't' of contact of the wedge changes sharply at 3–4 ΔY/ΔX and the degree 't' of contact of the wedge is good when the ΔY/ΔX is greater than 4. Therefore, it is preferable that the ΔY/ΔX is greater than 4.

In general, an inserted length of the wedge is 20 mm. Therefore, it is particularly required that the wedge insert ability is good to a point 20 mm from TOR. Moreover, a length 'a' from the electron beam deflection center to a fore end of the cone part has an influence to the deflection sensitivity less than a length 'b' from the electron beam deflection center to a rear end of the cone part. Therefore, it is preferable that the ΔY/ΔX is greater than 4 at a part starting from TOR up to approx. 20 mm in a neck 23 direction.

Figure 1:
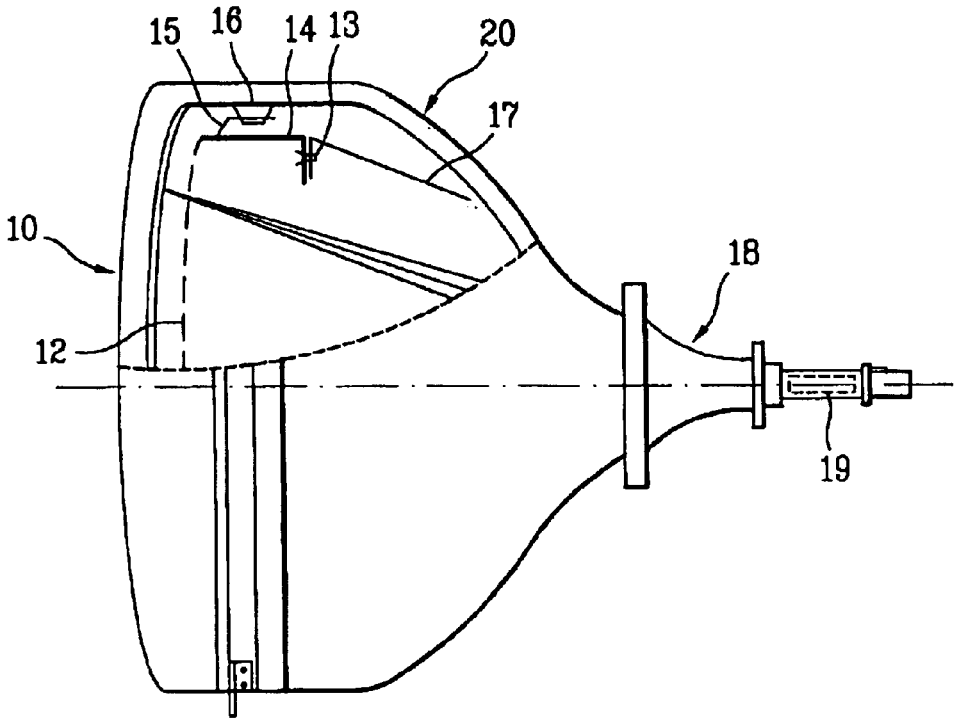
FIG. 1 Related Art
FIG. 1 illustrates a side view of a funnel of a related art CRT, with a partial cut away view.
Figure 11:
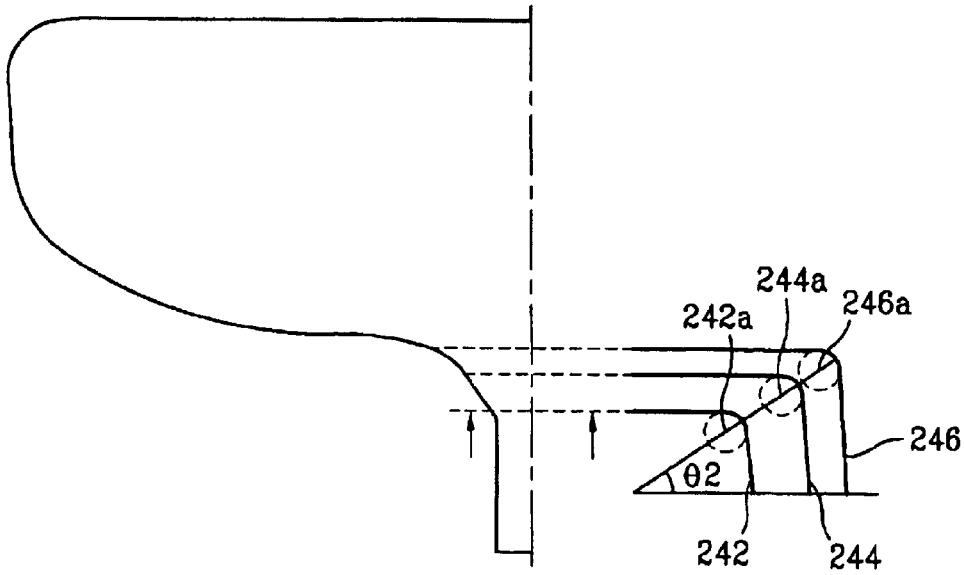
FIG. 11 illustrates a section of a cone part in a funnel of a CRT in accordance with a preferred embodiment of the present invention.

FIG. 11 illustrates a section of a cone part 22 perpendicular to the axis of the CRT, wherein a plurality of sections along an axis direction of the CRT are shown. As shown in FIGS. 1 and 11, it is preferable that centers 242*a*, 244*a*, and 246*a* of radiuses of curvature at the corner in the plurality of cone part sections 242, 244, and 246 in the axis direction are on the same line. In other words, it is preferable that diagonal angles θ2 of the plurality of cone part sections 242, 244, and 246 are the same, otherwise an outside surface of the corner of the cone part 22 will be non-linear, to cause a stress concentration.

Moreover, it is required that the diagonal angle θ2 of the cone part 22 is the same with the diagonal angle (an angle between the long axis and the short axis of the screen effective surface) of the effective surface of the screen, to keep a linearity of the corner continuous from the cone part 22 and the body part 21 of the funnel 20 to the panel, for prevention of the stress concentration caused by a non-linearity.

In the meantime, the foregoing embodiment explains a funnel of a CRT of the present invention in view of a form of a cone part section. A funnel of a CRT in accordance with a preferred embodiment of the present invention will be explained in view of lengths of the body part and cone part of the funnel, hereafter.

Figure 2:
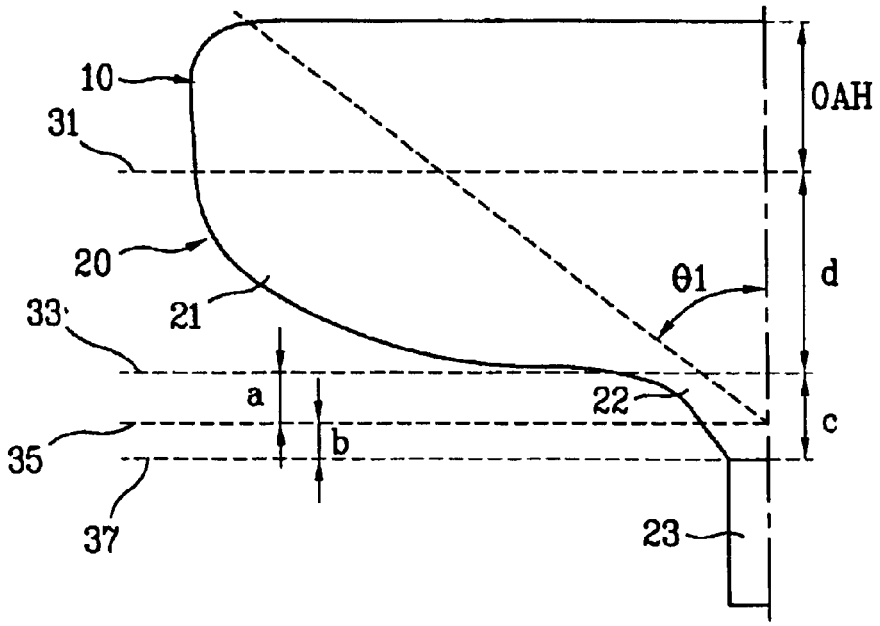
FIG. 2 Related Art
FIG. 2 illustrates a plan view of FIG. 1.

Referring to FIG. 2, a distance from TOR 33 to the neck seal 37 is a length 'c' of the cone part, and a distance from the seal line 31 to TOR 33 is a length 'd' of the body part. The cone part length 'c' may be allocated into a distance 'a' from the reference line 35 to TOR 33, and a distance 'b' from the reference line 35 to the neck seal 37.

It is important that a length 'd' of the body part of the funnel 20 and a height OAH of the panel 10 are allocated, appropriately. Though the panel 10 is not favorable in view of the vacuum strength in comparison to the funnel 20 due to a straight section of the panel 10, the panel 10 can be reinforced by means of thickness. However, because the funnel 20 is, though favorable in view of the vacuum strength as the funnel 20 is curved, not favorable due to thickness, it is required that the funnel 20 is designed, appropriately. In the funnel 20 with the non-circular cone part, a part a long side of the cone part 22 and the body part 21 meet, i.e., TOR part is weak as the radius of curvature is the smallest. Therefore, an appropriate allocation of lengths of the body part 21 and the cone part 22 is required such that strength of the TOR part is adequate.

Figure 12:
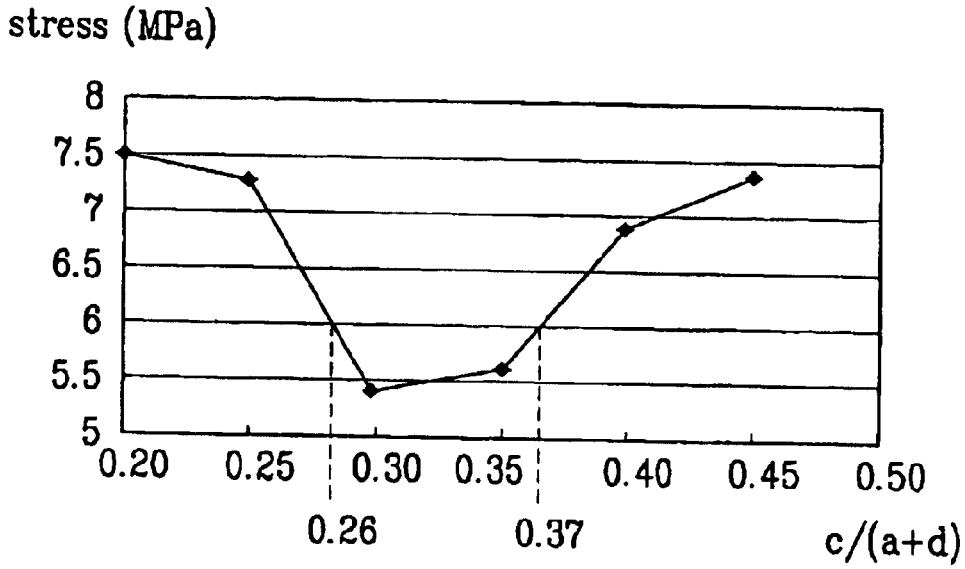
FIG. 12 illustrates a graph showing vacuum strengths varied with lengths of various parts of the funnel of a CRT in accordance with another preferred embodiment of the present invention.

FIG. 12 illustrates a graph showing stresses at TOR varied with c/(a+d), referring to which relations of a length (a+d) from the reference line 35 to the seal line 31 and a length 'c' of the cone part will be explained. When c/(a+d) is 0.20, 0.25, 0.30, 0.35, 0.40, or 0.45, the stress is 7.5, 7.2, 5.4, 5.6, 6.8, 7.3 MPa, respectively.

As can be noted in FIG. 12, since the stress at TOR is approx. 6 MPa if 0.26<c/(a+d)<0.37, the funnel 20 is safe in view of strength.

Moreover, as the c/(a+d) becomes the greater, though the stress becomes the smaller for some extent, the stress becomes the greater again. Because the greater the c/(a+d), the smaller the length 'd' of the body part, the stress at the body part 21 becomes the greater. That is, the stress is the smallest when the c/(a+d) is within a range of 0.26–0.37.

At the end, considering strength of the CRT, it is preferable that the c/(a+d) is within a range of 0.26–0.37, and more preferably within a range of 0.30–0.35.

Meanwhile, as explained, it is required that the shade phenomenon is prevented. The shade phenomenon is related to a BSN (Beam Strike Neck). The BSN is a distance the deflection yoke is moved from a point the deflection yoke is brought into contact in a screen direction toward a neck direction until no electron beam hits the screen such that the electron beam can not make the fluorescent film luminescent.

Figure 14:
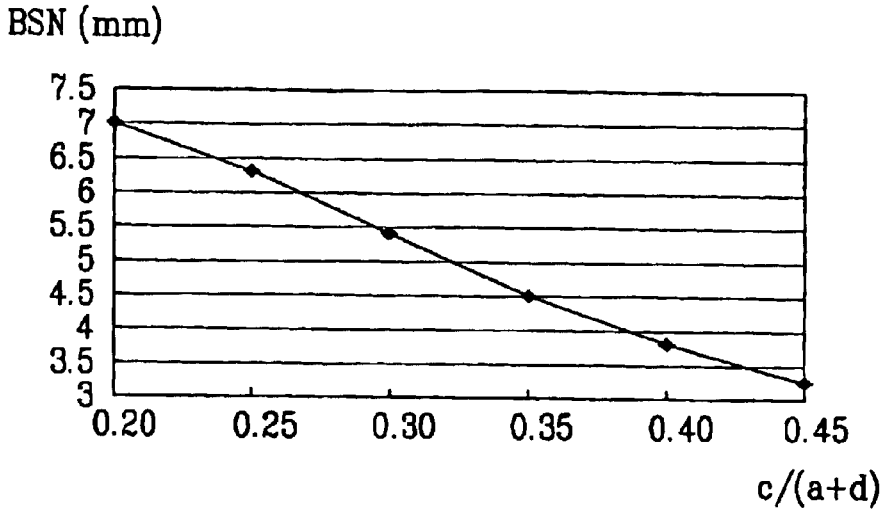
FIG. 14 illustrates a graph showing BSN varied with lengths of various parts of the funnel of a CRT in accordance with another preferred embodiment of the present invention.

Referring to FIG. 14, for preventing the shade phenomenon, it is preferable that the BSN, which becomes the smaller as the c/(a+d) is the greater, is greater than 4.5 mm. Accordingly, it is preferable that the c/(a+d) is below approx. 0.35.

In the meantime, the non-circular cone part has difficulty in inserting a device for fitting the deflection yoke in comparison to the circular cone part due to sharp change of curvature in the body part 21 and the cone part 22 (see FIG. 9). Therefore, it is preferable that lengths of different parts of the funnel are fixed taking, not only the strength, but also the wedge insert ability into account.

The deflection yoke is designed taking the reference line 35 of the cone part 22 as a mechanical center. Therefore, a deflection power is fixed by the length 'b' from the reference line to the neck seal, and the wedge insert ability is fixed by the length 'a' from the reference line to TOR.

Since the longer the length 'a' from the reference line to TOR, the better the contact between the wedge and the cone part, the longer the length 'a', the deflection yoke can be fixed to the cone part 22 the more stably. Moreover, as a size of the deflection yoke is limited, when the length 'a' from the reference line to TOR is small, the deflection yoke can not deflect the electron beam enough to display a desired picture size even if the same current is applied, thereby deteriorating a product quality. However, if the length 'a' from the reference line to TOR is great excessively, the length 'c' of the cone part may be increased, to cause the shade phenomenon.

Figure 13:
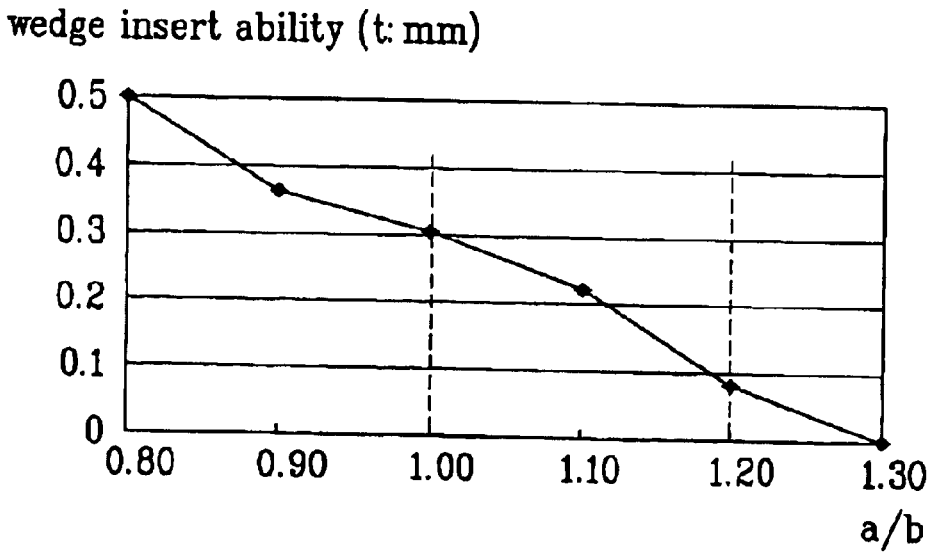
FIG. 13 illustrates a graph showing wedge insert abilities varied with lengths of various parts of the funnel of a CRT in accordance with another preferred embodiment of the present invention.

Referring to FIG. 13, when a/b is 0.80, 0.90, 1.10, 1.10, 1.20, 1.30, the degree 't' of contact of the wedge and the cone part is 0.5, 0.35, 0.31, 0.22, 0.08, 0.0, respectively. As explained, considering the wedge insert ability, the deflection yoke efficiency, the shade phenomenon, and the like, it is preferable that the degree 't' of contact of the wedge and the cone part is 0.1–0.3. Therefore, it is preferable that a/b is in a range of 1.0–1.2.

In the meantime, it is preferable that the deflection angle θ1 is in the range of 100°–120°. Because if the deflection angle is smaller than 100°, the foregoing formula is not satisfied owing to the small stress at the cone part, and if the deflection angle is greater than 120°, the sensitivity can not be satisfied.

As has been explained, the funnel in a CRT of the present invention has the following advantages.

First, by allocating lengths of different parts of the cone part, an adequate vacuum strength can be secured, and a good deflection sensitivity can be obtained.

Second, the good wedge insert ability provided the present invention permits a stable fitting of the deflection yoke, and reduction of a quality spread of the CRTs.

It will be apparent to those skilled in the art that various modifications and variations can be made in the funnel in a CRT of the present invention without departing from the spirit or scope of the invention. Thus, it is intended that the present invention cover the modifications and variations of this invention provided they come within the scope of the appended claims and their equivalents.

What is claimed is:

1. A funnel in a CRT (Cathode Ray Tube) comprising:

a body part welded to a panel;

a cone part connected to the body part having a deflection yoke fitted thereto; and a neck part connected to the cone part having an electron gun sealed therein, wherein the cone part is formed such that ΔY/ΔX {YD-(DD*sinθ2)}/{XD-(DD*cosθ2)} is greater than 4, where DD denotes a diagonal length, XD denotes a long axis length, YD denotes a short axis length, and θ2 denotes a diagonal angle between the long axis and the short axis.

2. The funnel in a CRT as claimed in claim 1, wherein the ΔY/ΔX=4.0–5.5.

3. The funnel in a CRT as claimed in claim 2, wherein the ΔY/ΔX=4.0–5.0.

4. The funnel in a CRT as claimed in one of claims 1–3, wherein a part starting from a part where the body part and the cone part are connected to a distance toward the cone part is formed to satisfy the range of the ΔY/ΔX.

5. The funnel in a CRT as claimed is claim 4, wherein the distance is approx. 20 mm.

6. The funnel in a CRT as claimed in one of claims 1–3, wherein the diagonal angle is the same with an angle the long axis and the short axis of the screen of the CRT form.

7. The funnel in a CRT as claimed in one of claims 1–3, wherein centers of radiuses of curvatures of a corner of the cone part are on the same line.

8. A funnel in a CRT (Cathode Ray Tube) comprising:

a body part welded to a panel;

a cone part connected to the body part having a deflection yoke fitted thereto; and a neck part connected to the cone part having an electron gun sealed therein, wherein the funnel is formed such that c/(a+d) is in a range of 0.26–0.37, where 'c' denotes a length of the cone part, 'd' denotes a length of the body part, 'a' denotes a length from a deflection center line of an electron beam to a front end of the cone part in the cone part, and 'b' denotes a length from a deflection center line of an electron beam to a rear end of the cone part in the cone part.

9. The funnel in a CRT as claimed in claim 8, wherein the c/(a+d) is in a range of 0.30–0.35.

10. The funnel in a CRT as claimed in claim 8, wherein the funnel is formed such that a/b is in a range of 1.00–1.20.

* * * * *